US008286262B2

(12) United States Patent
Rance et al.

(10) Patent No.: US 8,286,262 B2
(45) Date of Patent: Oct. 16, 2012

(54) GARMENTS

(75) Inventors: Jason Rance, London (GB); Deborah Yeomans, London (GB); Melanie Simmons, London (GB)

(73) Assignee: Speedo International Limited, London (GB)

( * ) Notice: Subject to any disclaimer, the term of this patent is extended or adjusted under 35 U.S.C. 154(b) by 406 days.

(21) Appl. No.: 11/839,870

(22) Filed: Aug. 16, 2007

(65) Prior Publication Data

US 2008/0141430 A1 Jun. 19, 2008

(30) Foreign Application Priority Data

Dec. 15, 2006 (GB) ..... 0625102.9
Apr. 5, 2007 (GB) ..... 0706766.3

(51) Int. Cl.
*A41D 7/00* (2006.01)
*A41D 13/00* (2006.01)

(52) U.S. Cl. ..... 2/67; 2/69

(58) Field of Classification Search ..... 2/69, 67
See application file for complete search history.

(56) References Cited

U.S. PATENT DOCUMENTS 2,072,184 A 3/1937 Rheinauer
2,527,224 A * 10/1950 Landy ..... 2/252
2,918,920 A 12/1959 Lutsky
3,333,589 A 8/1967 Cohen et al.
3,436,762 A 4/1969 Cahan ..... 2/67
3,489,154 A 1/1970 Kaspar et al.
4,095,291 A 6/1978 Di Tullio
4,103,360 A * 8/1978 Belpaume ..... 2/67
4,179,754 A * 12/1979 Denu ..... 2/67
4,298,008 A 11/1981 Kylberg
4,343,044 A 8/1982 Borda et al.
4,494,546 A 1/1985 Steiman
4,571,742 A 2/1986 Wior
4,654,894 A 4/1987 Kudo ..... 2/67
4,698,847 A 10/1987 Yoshihara ..... 2/69
4,741,719 A 5/1988 Wirth
4,781,651 A 11/1988 Ekins
4,862,517 A * 9/1989 Meistrell ..... 2/2.17
4,862,523 A * 9/1989 Lipov ..... 2/409
4,910,802 A 3/1990 Malloy
4,916,755 A 4/1990 Feigenbaum et al.
4,946,453 A * 8/1990 Monson ..... 604/312
4,956,878 A 9/1990 Boynton
4,972,522 A 11/1990 Rautenberg (Continued)

FOREIGN PATENT DOCUMENTS

CA 2 235 561 10/1998

(Continued)

OTHER PUBLICATIONS

Tokugikon, Jan. 25, 2002, No. 221, p. 1-8/E.

(Continued)

*Primary Examiner* — Alissa L Hoey
(74) *Attorney, Agent, or Firm* — Stites & Harbison PLLC; Marvin Petry

(57) ABSTRACT

This application describes garments (2), for example swim suits or other sports or athletic garments, in which a plurality of panels (10-22 & 30-44) are laminated on the outer surface of a base layer (4) of stretchable elasticated fabric to offer (in the case of a swim suit) improved performance for competitive swimmers through a reduction in surface drag, a reduction in form drag and/or improved stability in the water.

23 Claims, 14 Drawing Sheets

U.S. PATENT DOCUMENTS

| | | | | |
|---|---|---|---|---|
| 4,986,496 | A * | 1/1991 | Marentic et al. | 244/130 |
| 4,999,845 | A * | 3/1991 | Jenks et al. | 2/2.16 |
| 5,033,116 | A * | 7/1991 | Itagaki et al. | 2/67 |
| 5,033,986 | A | 7/1991 | Feigenbaum et al. | |
| 5,052,053 | A | 10/1991 | Peart et al. | |
| 5,069,403 | A * | 12/1991 | Marentic et al. | 244/130 |
| 5,081,716 | A | 1/1992 | Lehenbauer et al. | |
| 5,119,511 | A | 6/1992 | Packer et al. | |
| 5,133,516 | A * | 7/1992 | Marentic et al. | 244/130 |
| 5,201,074 | A | 4/1993 | Dicker | |
| 5,263,923 | A | 11/1993 | Fujimoto | |
| 5,359,732 | A | 11/1994 | Waldman et al. | |
| 5,367,708 | A * | 11/1994 | Fujimoto | 2/22 |
| 5,447,462 | A | 9/1995 | Smith et al. | |
| 5,487,710 | A * | 1/1996 | Lavorgna et al. | 482/55 |
| 5,533,961 | A | 7/1996 | Iwata | |
| 5,603,116 | A * | 2/1997 | Tronc | 2/2.15 |
| 5,605,060 | A | 2/1997 | Osborne | |
| 5,640,714 | A | 6/1997 | Tanaka | |
| 5,699,559 | A | 12/1997 | Sano | |
| 5,700,231 | A | 12/1997 | Wilkinson | |
| 5,720,042 | A | 2/1998 | Wilkinson | |
| 5,734,990 | A * | 4/1998 | Waring | 2/69 |
| 5,742,936 | A * | 4/1998 | Tronc | 2/2.15 |
| 5,749,365 | A | 5/1998 | Magill | |
| 5,762,535 | A | 6/1998 | Nishiyama et al. | |
| 5,768,703 | A | 6/1998 | Machado et al. | |
| 5,778,452 | A | 7/1998 | Dicker et al. | |
| 5,819,322 | A | 10/1998 | Dicker et al. | |
| 5,829,057 | A | 11/1998 | Gunn | 2/69 |
| 5,839,122 | A | 11/1998 | Dicker et al. | |
| 5,915,531 | A | 6/1999 | Hilpert et al. | |
| 5,937,442 | A | 8/1999 | Yamaguchi et al. | |
| 5,978,963 | A | 11/1999 | Moskowitz et al. | 2/67 |
| 5,987,933 | A | 11/1999 | Metzler | |
| 5,996,120 | A | 12/1999 | Balit | |
| 6,047,405 | A * | 4/2000 | Wilkinson | 2/69 |
| 6,061,829 | A | 5/2000 | Gunn | 2/69 |
| 6,061,832 | A | 5/2000 | Morrison, Jr. | 2/78.1 |
| 6,098,198 | A | 8/2000 | Jacobs et al. | |
| 6,195,801 | B1 | 3/2001 | Meyers | 2/67 |
| 6,292,947 | B1 | 9/2001 | Bechis | |
| 6,374,413 | B1 | 4/2002 | Magee | 2/69 |
| 6,401,497 | B1 | 6/2002 | Nishiyama et al. | |
| 6,438,755 | B1 | 8/2002 | MacDonald et al. | |
| 6,446,264 | B2 | 9/2002 | Fairhurst et al. | |
| 6,484,319 | B1 | 11/2002 | Fusco et al. | |
| 6,526,584 | B1 * | 3/2003 | Hunter | 2/2.16 |
| 6,546,560 | B2 | 4/2003 | Fusco et al. | |
| 6,647,550 | B1 | 11/2003 | Matsuzaki et al. | |
| 6,694,185 | B2 * | 2/2004 | Orton | 607/2 |
| 6,698,903 | B2 | 3/2004 | Hall | |
| 6,817,030 | B2 | 11/2004 | Desai | |
| 7,074,204 | B2 | 7/2006 | Fujii et al. | |
| 7,089,597 | B2 | 8/2006 | Horii et al. | |
| 7,096,506 | B2 * | 8/2006 | Ragot | 2/2.15 |
| 7,229,390 | B2 | 6/2007 | Fujii et al. | |
| 7,395,553 | B2 | 7/2008 | O'Hara | |
| 7,549,971 | B2 | 6/2009 | Bell et al. | 602/75 |
| 7,559,093 | B2 | 7/2009 | Sudo et al. | 2/69 |
| D601,778 | S * | 10/2009 | Rance et al. | D2/731 |
| 7,631,367 | B2 * | 12/2009 | Caillibotte et al. | 2/228 |
| 7,670,205 | B2 | 3/2010 | Oyama et al. | 450/97 |
| 7,670,666 | B2 | 3/2010 | Deguchi | 428/141 |
| 2002/0069450 | A1 | 6/2002 | McNamara | |
| 2002/0108160 | A1 | 8/2002 | Griffiths | |
| 2002/0116740 | A1 | 8/2002 | Saillet et al. | 2/2.15 |
| 2002/0152531 | A1 | 10/2002 | Fusco et al. | 2/2.15 |
| 2003/0101506 | A1 * | 6/2003 | Fujii et al. | 2/240 |
| 2003/0140391 | A1 | 7/2003 | Richards et al. | |
| 2003/0208829 | A1 | 11/2003 | Ragot et al. | |
| 2004/0107479 | A1 * | 6/2004 | Dicker et al. | 2/227 |
| 2004/0111781 | A1 | 6/2004 | Miyake et al. | |
| 2004/0194189 | A1 | 10/2004 | Liu | 2/69 |
| 2004/0234478 | A1 | 11/2004 | Clapp et al. | |
| 2005/0028241 | A1 * | 2/2005 | Ragot | 2/69 |
| 2005/0126229 | A1 | 6/2005 | Deguchi | |
| 2005/0142986 | A1 | 6/2005 | Belpaume | |
| 2005/0193461 | A1 * | 9/2005 | Caillibotte et al. | 2/69 |
| 2005/0198722 | A1 | 9/2005 | Nordstrom | |
| 2005/0223753 | A1 | 10/2005 | Nordstrom | |
| 2005/0229293 | A1 | 10/2005 | Miller | |
| 2005/0235465 | A1 * | 10/2005 | Butz | 24/389 |
| 2006/0272071 | A1 | 12/2006 | Mickie | 2/69 |
| 2007/0006356 | A1 * | 1/2007 | Shiue | 2/2.15 |
| 2007/0022510 | A1 | 2/2007 | Chapuis et al. | 2/69 |
| 2007/0033696 | A1 | 2/2007 | Sellier | 2/69 |
| 2007/0050881 | A1 | 3/2007 | Kasprzak | 2/69 |
| 2008/0066211 | A1 | 3/2008 | Laugt et al. | 2/69 |
| 2008/0078008 | A1 * | 4/2008 | Demarest et al. | 2/115 |
| 2008/0141431 | A1 | 6/2008 | Rance et al. | |
| 2008/0256675 | A1 * | 10/2008 | Di Lorenzo | 2/67 |
| 2008/0295216 | A1 | 12/2008 | Nordstrom et al. | 2/69 |
| 2009/0031486 | A1 | 2/2009 | Sokolowski et al. | 2/458 |
| 2009/0038047 | A1 * | 2/2009 | Di Lorenzo | 2/67 |
| 2009/0113596 | A1 * | 5/2009 | Young | 2/69 |
| 2009/0126413 | A1 | 5/2009 | Sorensen et al. | 66/196 |
| 2009/0300816 | A1 | 12/2009 | Brito et al. | 2/67 |
| 2010/0017931 | A1 | 1/2010 | Whaley | 2/67 |

FOREIGN PATENT DOCUMENTS

| | | |
|---|---|---|
| EP | 0 354 022 | 2/1990 |
| EP | 0 875 161 | 11/1998 |
| EP | 1 179 301 | 2/2002 |
| EP | 1 250 858 | 10/2002 |
| FR | 2 740 662 | 5/1997 |
| FR | 2 865 904 | 8/2005 |
| GB | 515219 | 11/1939 |
| GB | 996051 | 6/1965 |
| GB | 1 508 597 | 4/1978 |
| GB | 2 273 646 | 6/1994 |
| GB | 2 411 816 | 9/2005 |
| JP | 52057807 | 4/1977 |
| JP | 62-268803 | 11/1987 |
| JP | 1-213403 | 8/1989 |
| JP | 8-120507 | 5/1996 |
| JP | 8-311751 | 11/1996 |
| JP | 9-111514 | 4/1997 |
| JP | 9-119003 | 5/1997 |
| JP | 11-100705 | 4/1999 |
| JP | 11-152610 | 6/1999 |
| JP | 11-279810 | 10/1999 |
| JP | 2001-032104 | 2/2001 |
| JP | 2001-262409 | 9/2001 |
| JP | 2003-041464 | 2/2003 |
| JP | 2003-239113 | 8/2003 |
| JP | 2003-328212 | 11/2003 |
| JP | 2004-124325 | 4/2004 |
| JP | 2004-156153 | 6/2004 |
| WO | WO 98/18354 | 5/1998 |
| WO | WO 98/32347 | 7/1998 |
| WO | WO 99/04660 | 2/1999 |
| WO | WO 99/23903 | 5/1999 |
| WO | WO 00/45658 | 8/2000 |
| WO | WO 2005/039336 | 5/2005 |
| WO | WO 2005/112674 | 12/2005 |
| WO | WO 2006/043476 | 4/2006 |

OTHER PUBLICATIONS

Search Report for GB 0715652.4, Dec. 21, 2007, UK Intellectual Property Office.

Search and Examination Report for GB 0715653.2, Dec. 24, 2007, UK Intellectual Property Office.

Examiner's First Report on Patent Application No. 2007207872, Jun. 18, 2009, AU Intellectual Property Office.

Examiner's First Report on Patent Application No. 2007207873, Jun. 18, 2009, AU Intellectual Property Office.

Office Action issued Aug. 16, 2010 for co-pending U.S. Appl. No. 11/839,879, United States Patent and Trademark Office, Alexandria, Virginia.

Office Action issued Jan. 14, 2011 in co-pending U.S. Appl. No. 11/839,879, United States Patent and Trademark Office, Alexandria, Virginia.

* cited by examiner

GARMENTS

FIELD OF THE INVENTION

This invention has to do with garments that incorporate elastic stretch fabric and fit tightly to the body, typically for sports use. Particular examples are described in relation to swimsuits, which is a preferred use. However, the concepts described can be applied to other sports and athletic garments including, for example, beach volley, waterpolo and triathlon wear.

BACKGROUND

A number of known sports garments, especially racing swimsuits, are made from elasticated stretch fabric which fits closely and tightly against the body. In recent years use has been made of various fabrics with high elastane content having a high stretch constant to press more firmly against the body surface for a given degree of stretch. In racing swimsuits this reduces the entry of water between the suit and body—a source of drag—and avoids the sliding of the fabric over the skin. It can also reduce muscle vibration which is believed to be a cause of fatigue and body drag in swimming.

In our earlier applications EP-A-1110464 and EP-A-1250858 we describe swimsuits that provide an improved, highly-tensioned fit over the body, especially lower back and abdominal fit, using a special disposition of seams joining panels of elasticated stretch fabric that make up the swimsuit. The introduction of a seam across a span of stretch fabric was shown to reduce the stretchability, i.e. potentially increase a degree of tensioning, in a direction transverse to the seam.

As an additional measure to minimise the entry of water between the suit and body, EP-A-0411351 proposes the application of sheets of an air-tight and waterproof material to limited areas on a swimsuit adjacent openings (e.g. arm and neck openings). This is said to help prevent water intruding through the openings and the material of the swimsuit immediately adjacent the openings.

SUMMARY OF THE INVENTION

The present invention is generally concerned with structures for swimsuits (and other tight-fitting outer garments, especially sports garments) that can offer improved performance for competitive swimmers through a reduction in surface drag, a reduction in form drag and/or improved stability in the water. Another general proposition of the present invention is to offer swimsuits that have stroke-specific tailoring and that can serve to support accurate execution of the stroke.

In a first aspect the invention provides a garment having:

a base layer of stretchable elasticated fabric that covers at least the torso; and a plurality of panels laminated on the outer surface of the base layer.

Preferably the panels cover 10% or more of the torso.

More preferably the panels cover 15%, 20%, 25%, 30%, 35%, 40%, 45% or even 50% or more of the torso. In some preferred embodiments, the panels cover 20% or more of the rear of the torso and may cover as much 30%, 40% or even 50% or more of the rear of the torso. It is particularly preferred that the panels cover at least 50% of the front of the torso and in some embodiments may cover as much as 60%, 70% or 80% or more of the front of the torso. In some embodiments the panels will cover more of the front of the torso than of the rear of the torso.

Competition swimsuits (and some other sports garments) often also cover either the whole or part of an athelete's legs. Applying the principles of the invention to such suits, the legs of the suit preferably also have one or more panels laminated on their outer surface. The panels may cover 20%, 25%, 30%, 35%, 40%, 45%, 50% or more of each leg and in some embodiments cover 75% or more.

Whilst it would be possible also to apply the principles of the invention to the arms of a suit (where present), it is generally more preferable to ensure that the athlete's arms have as much freedom as possible to move. Preferably, therefore, where the suit has arms, the arms of the suit are made from a lightweight fabric (either the same fabric as the suit torso or a lighter weight fabric) and there are no panels laminated onto the arms.

More generally, the swimsuit (or other sports wear) may cover e.g.

(i) the whole body, including the full length of the arms and legs;

(ii) as (i) but not the arms;

(iii) as (i) or (ii) but not the legs, or the legs only down to knee-length;

(iv) the torso only, i.e. no arms or legs;

(v) the midriff and legs only, either full-length (long-john), shorts or knee-shorts.

In a second aspect the invention provides a garment having a base layer of stretchable elasticated fabric that covers at least the legs and a plurality of panels laminated on the outer surface of the base layer.

The panels may cover 20% or more of the legs of the suit.

In this aspect, the panels preferably cover 25%, 30%, 35%, 40%, 45%, 50% or more of each leg of the suit and in some embodiments cover 75% or more.

The panels applied to the torso and/or limbs of suits according to the present invention are preferably formed of a material having a higher stretch constant than that of the underlying base layer and are applied to areas of the torso in which it is desired for the suit to be more tensioned when worn to provide greater support and/or to reduce the form of the underlying part of the athlete's (e.g. swimmer's) torso, to reduce form drag in the water.

The panels are preferably formed of a material having an outer surface that is more 'slippery' (i.e. exhibits lower surface drag in water) than the underlying base layer. In this way, the surface drag of the overall suit is reduced by application of the panels, especially where the panels cover a substantial percentage of the surface of the suit.

The material for the panels is preferably selected to combine both of the above benefits.

Suitable materials for the panels include polyurethane sheet material. The properties of the polyurethane material (or other equivalent material) can be selected to give the desired stretch characteristics.

For currently envisaged applications, preferred properties include a material weight in the range 70 g/m$^2$ to 110 g/m$^2$, more preferably 80 g/m$^2$ to 100 g/m$^2$, even more preferably 85 g/m$^2$ to 95 g/m$^2$, for example 90 g/m$^2$. The thickness of the sheet material is preferably in the range 50 microns to 100 microns, more preferably 60 microns to 90 microns and even more preferably 70 microns to 80 microns, for example 75 or 76 microns.

Exemplary polyurethane materials include two layer polyurethane films, with an adhesive layer (for adhering to the underlying garment fabric) and a thick film face side layer, which may have a matt finish. The adhesive layer may provide ⅔ of the overall sheet thickness. The adhesive preferably has a softening point in the range 60° C. to 80° C., for example 72°

C. (TMA onset temperature). The service temperature range of the adhesive is preferably at least −20° C. to 60° C. and more preferably −40° C. to 75° C.

Whilst the panels may all have the same properties, in some applications they may advantageously have different properties from one another (e.g. different stretch constants, for instance as a result of having different weights and/or thicknesses) to provide greater tailoring of the properties of the suit over the athlete's body.

The elastic stretch fabric used to make the suit may be of any suitable kind. Fabrics of high stretch constant, e.g. polyester elastanes as conventionally used for making high-performance swimwear, are within the skilled person's routine knowledge.

The more of the surface of swimsuit (or other sports wear) is covered with a low drag material the greater will be the improvements (reduction) in surface drag. However, the present inventors have recognised that low drag materials very often have very high stretch constants and/or very low water permeability. Especially in competition swimsuits, it is important that there is sufficient 'give' in the suit to allow the swimmer to efficiently execute their stroke. If a suit is too highly tensioned then energy will be wasted overcoming the resistance the suit offers to the swimmer's movements. It is also important that water can escape from within the suit to avoid a build up of water between the suit and the swimmer's skin, which results in increased drag.

We propose, therefore, to retain specific areas of the swimsuit free of panels to enable venting of water from within the suit and/or efficient stroke execution. Put another way, the panels are preferably located on specific areas of the base layer to maximise the benefits of reduced surface and form drag, increased support and/or compression of muscles to improve power, whilst minimising the resistance the suit provides to articulations of limbs and bending or twisting of the torso necessary for execution of the swimming stroke. Similar principles can be applied to the design of garments for other sports activities requiring particular body movements/forms.

Whilst some optimisation of the position of the panels to balance these potentially conflicting requirements is possible in a generic suit (i.e. one intended for all strokes), we have found that more optimal results can be achieved by designing the layout of the panels across the surface of the suit dependent on the requirements of specific strokes.

One or any combination of two or more of the following panel locations are preferred (the suggested function of each panel being in addition to a potential reduction in surface drag and form drag that all the panels can provide):

- To support a swimmer's core, a panel on the front of the suit covering the swimmer's abdomen. The panel may be generally rhomboidal, extending down to the crotch and up to the sternum.
- Also to support the swimmer's core, one or more panels extending across the swimmer's lumbar region. A single band across the lumbar region may suffice, although it may be necessary to provide a central split extending from the upper edge of the band at least part way down to accommodate the lower end of a zip fastener, typically positioned down the centre of the swimmer's back.
- To compress the buttocks in order to reduce form drag, one or more panels extending over the buttocks. Conveniently the lumbar panel, where used, may extend down over the buttocks to provide the desired compression.
- To compress the chest, particularly for female swimmers, a panel or panels covering the chest. The configuration of the panel(s) is chosen to alter the form of the chest without restricting lung function to any significant degree. Preferably two panels are used, one to either side of the sternum. They may extend from the neckline down to approximately the bottom of the rib cage. Where an abdominal panel is used, they may extend respectively to the left and right medial sides of the abdominal panel.
- For strokes with a leg kick in which the legs remain generally straight (freestyle, backstroke, butterfly), to support the legs, a panel extending over the quadriceps muscle group on the front of the thigh, a panel extending over the hamstring muscle group on the rear of the thigh, upper leg and panels on the front and rear of the lower part of each leg (shin and calf), preferably in each case covering about 80% or more of the relevant muscle group. Preferably a band around each knee is kept free of any panels to allow some flexing of the knee.
- For breaststroke, to support the breaststroke leg kick, a series of panels on the legs similar to those described above are provided. However, the calf panels are preferably shaped to wrap further forward around the lateral side of the leg below the knee and at the ankle than in the middle of the calf. The panel on the front of the lower leg is correspondingly foreshortened laterally to retain a spacing between the calf panel and the lower front leg panel. The quadriceps panels preferably stop at the hip so as not to hinder articulation of the hip joint. The lower lateral corner of each hamstring panel preferably also wraps around towards the front of the leg just above the knee. In some cases it will be preferable to cut off the legs of the suit above the knees to give greater freedom of movement for the swimmer's lower legs when executing the breaststroke kick.
- To provide support for the back without hindering motion in strokes that require twisting of the upper part of the trunk (e.g. freestyle and backstroke), a pair of panels are preferably provided on the back extending from the centre of the back in the lumbar region upwardly towards the shoulders. The panels may be strip shaped and may be angled laterally outwardly up the back, so they diverge at their upper ends. Conveniently, these back supporting panels may be formed in one piece with the lumbar panel where provided. The lateral sides of the trunk below the armpits are free of panels.
- To provide support for the back without hindering motion in strokes that require arching of the back without lateral movement (e.g. breaststroke and butterfly), a pair of panels may be provided on the back of the suit, spaced to either side of the spine, to wrap around from the back to the lateral sides of the trunk below the arms. This provides good support, minimising lateral movement, whilst leaving a relatively broad area spanning the spine free from panels so as not to provide excess resistance to the arching of the back.

Embodiments of the present invention may employ panels in one or any combination of two or more of the positions noted above.

One notable source of surface drag in known competition swimsuits is the zip fastener. Typically the zip fastener extends vertically along the centre of the back of the swimsuit from the neck opening down to the lumbar region. In a further development the present invention provides a zip fastener that has a lower external profile than conventional zip fasteners. To achieve a lower external profile, the zip may be fastened to the suit (or other garment) with what would normally be the underside of the zip facing outwards, so that the flat underside of the zip teeth is facing externally, whereas the raised teeth themselves face to the inside of the suit. The adjacent fabric of the suit preferably also extends close to the centre line of the zip so that only a small band (e.g. less than 5, 4, 3, 2 or even 1 mm) of the zip tape is exposed to either side of the join line of the zip. The edges of the suit fabric adjacent the zip fastener are preferably laser cut to give a sharp edge. The zip tape is preferably bonded to the suit fabric, avoiding the additional drag that can be created with stitching.

This zip fastener arrangement can be used to advantage in other swimsuits (and other sports garments), especially where minimising surface drag is an important factor, independently of the other aspects of the invention discussed above.

It is also important to ensure that the edges of the suit at openings, e.g. neck openings, ankles, shoulder, wrists, etc fit snugly and comfortably against the athlete's body. Conventionally, the openings of swimsuits and other sports garments are hemmed with stitching to provide the desired fit. However, this creates a raised area on the outside surface of the suit, increasing drag. Swimsuits (or other garments) according to preferred embodiments of the present invention preferably use an edging strip mounted around the openings on the inside surface of the suit. The edging strip is preferably bonded to the inside surface of the suit. Suitable materials for the edging strip include neoprene. The weight and thickness of the edging strip material can be selected to provide a snug fit to the wearer's body.

These edging strips can be used to advantage in any swimsuits (or other garments), independently of the other aspects of the invention set forth above.

BRIEF DESCRIPTION OF THE DRAWINGS

Preferred embodiments of the invention are now described by way of example as applied to racing swimsuits, with reference to the accompanying drawings in which.

DETAILED DESCRIPTION

Figure 1:
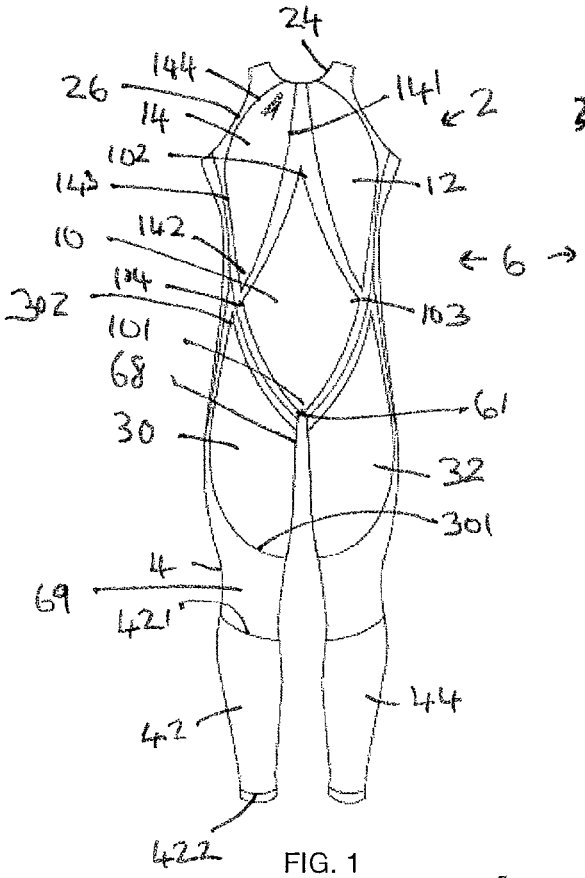
FIG. 1 is a front view of a full body suit with no arms, adapted especially for the freestyle stroke.

In general terms, we have found that, compared with prior art swimsuits formed from a single layer of fabric, superior results can be achieved by applying (laminating) panels of less elastic (higher stretch constant) and/or more 'slippery' (i.e. lower surface drag to reduce resistance in water) material in specific locations on a base layer fabric that gives the swimsuit its overall form.

This may be somewhat surprising to those skilled in the art because trends in the field are towards single layer fabric suits with low profile seams in order to minimize surface drag. The present inventors have recognised, however, that there are limits to the performance improvements that can be achieved with a single layer approach. More specifically, they have recognised that whilst performance can be enhanced, as described for example in our earlier EP-A-1110464, by increasing the tension in the suit when worn to ensure a closer fit to the swimmer's body, there is a point at which the increased tension begins to hinder the swimmer's performance of their swimming stroke as the suit restricts their movement. By selectively laminating panels on the outer surface regions of the base layer fabric of the swimsuit, as the inventors now propose, it becomes possible to offer performance enhancements over single layer suits, whist retaining many of the benefits of such single layer suits by appropriate placement of the panels so as not to inhibit the articulation of the swimmer's limbs and torso necessary for a particular stroke.

The inventors have identified three distinct potential functional benefits that can be achieved with this topical lamination of panels (i.e. application of the panels at positions on the suit corresponding to selected, localised areas of the body when the suit is worn).

The first is an overall reduction in surface drag by using panels that are more 'slippery' in water than the fabric of the underlying base layer.

The second potential benefit is a reduction in form drag by applying panels at body 'high points', such as buttocks and breasts, to provide an area of increased stretch constant, the resultant higher tension in the suit when worn applying greater compressive forces to the high points to reduce their form. Preferably the panel material itself has a higher stretch constant than the fabric of the underlying base layer. Some improvement in the tensioning of the area of the suit to which the panel is applied is seen, however, even with panels of material having the same or a lower stretch constant than the base layer (the overall tension being a sum of the forces generated in the base layer and the panel).

The third potential benefit is to help generate an increase in muscle power generation by using panels to create more highly tensioned areas of the suit adjacent (preferably surrounding) specific muscles or muscle groups to apply compression to them.

Advantageously, two or all three of these benefits can be obtained by the use of a single panel. For instance, if a panel is formed from a low drag, high stretch constant material it can serve to reduce surface drag in the region of the suit to which it is applied as well as to apply compressive forces to muscles and/or body high points.

Furthermore, by careful study of various swimming strokes, the inventors have realised that the configuration of the laminated panels can be designed not only to avoid unduly constraining the swimmer but actually to support the swimmer through the stroke by providing enhanced core stability and encouraging accuracy of stroke execution by offering less resistance to movement of the swimmers limbs and torso for the motions required for accurate stroke execution. This has led the inventors to develop a series of swimsuits specifically adapted for the different swimming strokes, as illustrated in the accompanying figures.

The illustrated suits are all made from a base layer of high stretch constant elastane fabric of a known kind.

The base layer may be formed from multiple sections joined to one another. The sections may be joined by stitching as described, for example, in our EP-A-1110464. More preferably, however, adjacent sections of the base layer are bonded to one another. Such bonded seams have been found to have particularly low profiles and resultant low drag properties in water.

Figure 13:
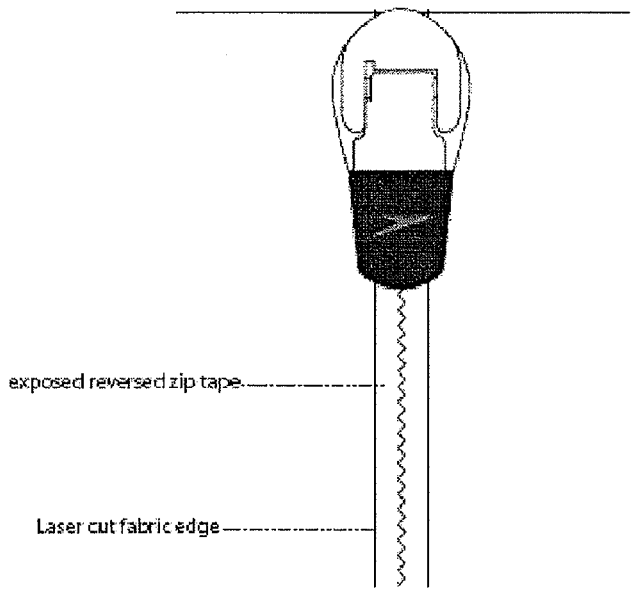
FIG. 13 is a schematic illustration of a low profile zip fastener used in the suits of the preceding figures.

As is normal, the suits have zip fasteners to allow a swimmer to don and take off the suit. Preferably the zip fastener has a low profile and is bonded to the sections of the suit that it joins to minimise the drag. As can be seen in FIG. 13, to achieve a lower external profile, the zip fastener is bonded to the suit with what would normally be the underside of the zip facing outwards, so that the flat underside of the zip teeth is facing externally, whereas the raised teeth themselves face to the inside of the suit. The adjacent fabric of the suit preferably extends close to the centre line of the zip so that only a small band (no more than about 2 mm) of the zip tape is exposed to either side of the join line of the zip.

In the suits intended for freestyle, breaststroke and butterfly, the zip fastener extends down the centre of the back of the suit in a normal manner. In the backstroke suit the zip fastener may alternatively be located on the front of the suit (e.g. down the middle of the chest/abdomen). However, the low profile nature of the zip fastener means that even for the back stroke suit it can be located on the swimmer's back without significantly increasing the drag in the water.

Figure 14:
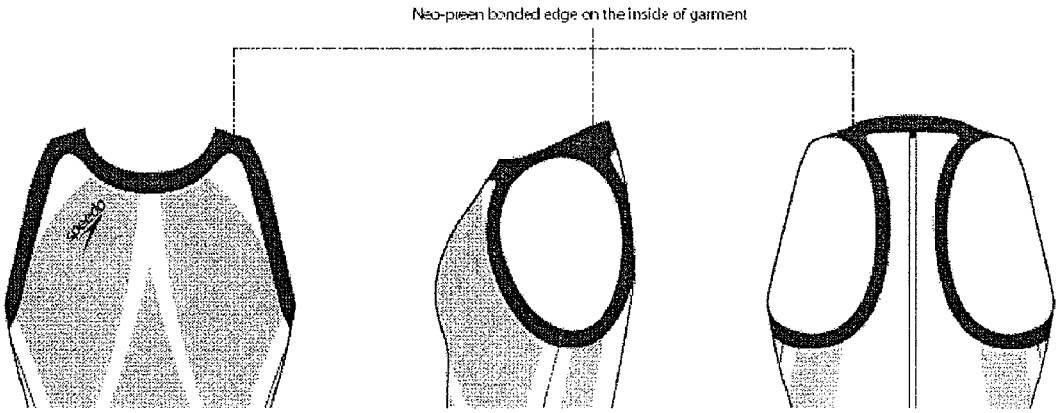
FIG. 14 is a schematic illustration of edging strips used at openings of the suits of FIGS. 1 to 12.

It is normal to apply an edging strip to edges of a swimsuit at openings (e.g. neck, arms, ankles). In the illustrated suits a thin polyurethane tape is preferably used for edging the openings to ensure that the edging has a low profile. Alternatively the edging may be formed from neoprene. Preferably it is bonded to the inside surface of the suit adjacent the openings, as shown schematically in FIG. 14.

The suits have panels of a polyurethane material laminated on the outer surface of the base layer at selected locations, in accordance with the present invention.

In this example, the polyurethane material is a two layer polyurethane film, with an adhesive layer (for adhering to the underlying garment fabric) and a thick film face side layer, which may have a matt finish. The material has a weight of about 90 g/m$^2$ and an overall thickness of about 76 microns, with the adhesive layer providing ⅔ of the overall thickness. The adhesive has a softening point of 72° C. (TMA onset temperature) and a service temperature range of −40° C. to 75° C.

The suits of the various examples differ in the configuration of the laminated panels, the configuration in each case being selected to support a specific swimming stroke, as discussed in more detail below.

Figure 3:
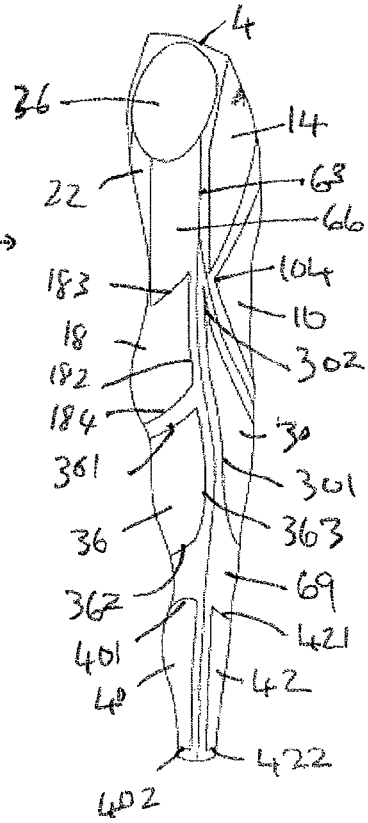
FIG. 3 is a side view of the FIG. 1 suit.
Figure 2:
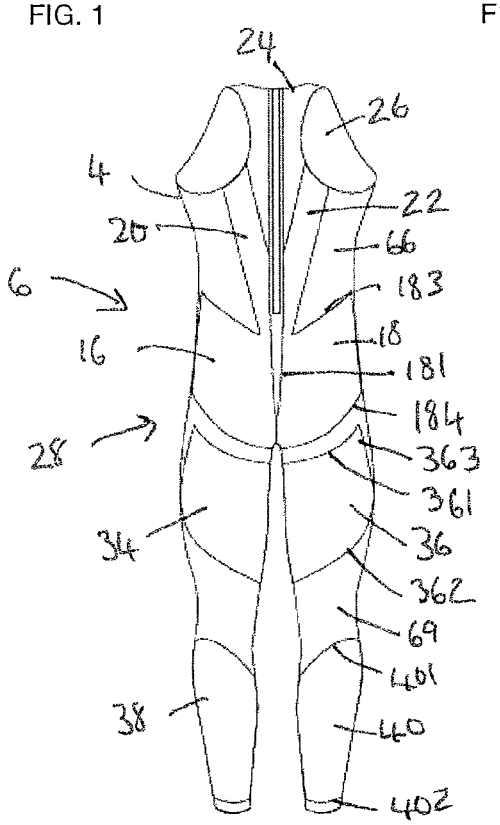
FIG. 2 is a back view of the FIG. 1 suit.

FIGS. 1 to 3 show a body suit 2, the base layer 4 of which covers and fits closely over the entire torso 6 and also the legs 8 to the ankles. In this example the suit has no arms but the principles illustrated are applicable also to arms with suits. The suit is especially adapted for use by freestyle swimmers.

A characteristic feature of the suit is a unique disposition of multiple specially-shaped panels laminated on the outer surface of the suit, which provide areas of reduced surface drag and/or greater compression and/or support of a swimmer's body without inhibiting the swimmer's stroke. In fact, the selective support provided by the laminated panels can help support and maintain the form of the swimmer's stroke.

The torso region 6 of the suit 2 has three panels on the front, an abdominal panel 10 and left- and right-side chest panels 12, 14. On the rear or the torso region 6 there are left- and right-side lumbar panels 16, 18 and left- and right-side back panels 20, 22, which in this example extend from and are formed integrally with the lumbar panels 16, 18.

The abdominal panel 10 is generally rhomboidal in shape. A bottom corner 101 of the panel 10 extends down to the crotch region 61 of the suit. A top corner 102 of the panel extends up to the sternum region 62. Left and right corners 103, 104 of the panel extend laterally towards the side of the torso region 6, terminating just short of the mid-line 63 of the side of the torso. The abdominal panel 10 provides an area of low surface drag as well as providing a highly tensioned region to give greater core stability.

The chest panels 12, 14 are symmetrical with one another about the centre line of the front of the suit. The right-side chest panel 14 is generally triangular in shape. It has a medial side edge 141 that extends from the neck opening 24 down to a point at the bottom end 142 of the panel adjacent to but spaced from the left-side corner 104 of the abdominal panel 10. The side edge 141 is slightly convex in shape. A lateral side edge 143 of the chest panel 14 extends generally vertically from the bottom end 142 of the chest panel 14 to a position close to the lower edge of the right arm opening 26 of the suit. A top side edge 144 of the chest panel 14 extends in a convex curve from the top end of the lateral side edge to the neck opening 24 at a point close to but laterally outward from the top end of the medial side edge 141. The left-side chest panel 12 is a mirror image of the right-side chest panel 14.

The chest panels 12, 14 are configured to avoid restricting the swimmer's lung function. This may be achieved through appropriate shaping of the panels and/or through selection of a material with an appropriate stretch constant. The material may be the same as used for other panels on the suit. If needs be, however, the chest panels may be formed of a material having a lower stretch constant that the abdominal panel 10 (and the other panels discussed below) so they are less tensioned when the suit is worn in order that they do not overly restrict the swimmer's breathing. The chest panels 12, 14 serve to flatten the swimmer's chest, reducing form drag, as well as providing further areas of low surface drag.

The lumbar panels 16, 18 are generally trapezoidal in shape, with (taking the right-side panel as an example) generally vertical medial and lateral side edges 181, 182 and top and bottom edges 183, 184 that rise upwardly on the torso in the lateral direction. The lower part of the lumbar panel 18 extends down over the buttock area 28. The bottom edge 184 is slightly convexly curved to generally follow the lower edge of the swimmer's buttock (gluteus maximus). The top edge 183 is generally in line with the lowermost rib. The left-side lumbar panel 16 is a mirror image of the right-side panel 18.

The two lumbar panels 16, 18 meet one another at a lower end portion of their respective medial sides edges, at the crotch region 61. The medial side edges diverge slightly from one another towards the upper edge of the panels.

The lumbar panels 16, 18 provide highly tensioned areas to support the lumbar region, improving core stability. They also compress the swimmer's buttocks, reducing form drag and provide large surface areas of the suit with low surface drag.

The right-side back panel 22 has the form of narrow oblong extending from the centre line of the back of the suit adjacent the top edge of the lumbar panel 18 diagonally outwardly across the back to the arm opening 26, generally adjacent a lower edge of the scapula. The upper end 221 of the back panel 22 is laterally spaced from the centre line of the back of suit by a distance that is about one third of the distance between the back centre line and the centre line 63 of the right-side of the suit. This leaves a relatively large panel-free torso portion 66 of the suit under the arm opening 26 between the tope edge 183 of the lumbar pad, the lateral side edge 143 of the right-side chest panel 14 and the back panel 22. In use this arrangement provides support for the upper back whilst enabling relatively free twisting of the upper back and shoulder girdle of a swimmer, necessary for execution of the freestyle (front crawl) stroke. This, in turn, encourages correct execution of the stroke.

The left-side back panel 20 is a mirror image of the right-side back panel 22.

The illustrated suit also has a pair of panels applied to each leg. On each leg there is an upper leg panel that wraps around the inside of the leg from the front to the rear, comprising a quadriceps ('quad') panel portion 30, 32 on the front of the thigh (upper leg) and a hamstring panel portion 34, 36 on the rear of the upper leg. On each leg there is also a lower leg panel, which also wraps around the inside of the leg, comprising a calf panel portion 38, 40 on the rear of the lower leg and a shin panel portion 42, 44 on the front of the lower leg. The panels on the left leg are a mirror image of the panels on the right leg.

Looking at the right leg, the quad panel portion 30 has a lateral side edge 301 that extends in a convex sweeping line from the inside of the leg just above the patella out to the lateral side of the leg and up to a point 302 at the hip, generally following the outline of the quadriceps muscle group. A top edge 303 of the quad panel portion extends from the top point 302 to an inner leg region 68 adjacent the crotch region 61. The quad panel portion 30 covers substantially the whole of the quadriceps muscle group, applying compression to the muscles to enhance the power generated by them. The panel also helps to reduce surface drag over the front of the upper leg.

The hamstring panel portion 36 is generally trapezoidal in shape. It extends across the full width of the rear upper part of the leg, extends down to just above the rear of the knee joint at the inside of the leg and extends up to just below the buttock. The upper edge 361 of the panel portion 36 is convexly curved and is spaced from but closely follows the line of the bottom edge 184 of the lumbar panel 18. The bottom edge 362 of the hamstring panel portion is gently curved, concavely, to rise up towards the lateral side of the leg where it merges into the lateral side edge 363, which extends, also in a gently convex curve, to meet the lateral end of the upper edge 361 at an acute angle.

The hamstring panel portion applies compression to the hamstring muscles in use to enhance the power generated by those muscles. It also helps to reduce surface drag over the rear of the leg.

The quadriceps and hamstring panel portions 30, 36 wrap around the inside of the leg to meet one another, forming one continuous panel wrapping around the inside of the upper leg. Opposite ends of the panel terminate on the outside of the leg, spaced from one another to either side of a seam running down the outside of the leg.

The calf panel portion 40 and shin panel portion 42 between them extend most of the way around the lower leg from just below the knee to the ankle. As with the upper leg panel portions, these panel portions wrap around the inside of the leg to form a continuous panel with opposite ends terminating on the outside of the leg to either side of the leg seam.

Both lower leg panel portions 40, 42 extend slightly higher up the lateral side of the leg than the medial side of the leg. The upper edge 401 of the calf panel portion is convexly curved to generally follow the shape of the underlying muscles in the calf (in particular the gastrocnemius muscle). The upper edge 421 of the shin panel portion 42, on the other hand, is concavely curved to provide clearance around the lower part of the front of the knee joint. The bottom edges 402, 422 of the calf and shin panel portions 40, 42 are generally horizontal and in-line with one another.

The calf panel portion 40 applies compression to the muscles of the calf (gastrocnemius and soleus muscles) and the shin panel portion 42 covers and applies compression to the tibialis anterior muscle. This compression can increase the power generated by the muscles. The panel portions 40, 42 also reduce the surface drag over the lower leg.

A band 69 around each knee is kept free or any panels to allow some flexing of the knee.

Figure 4:
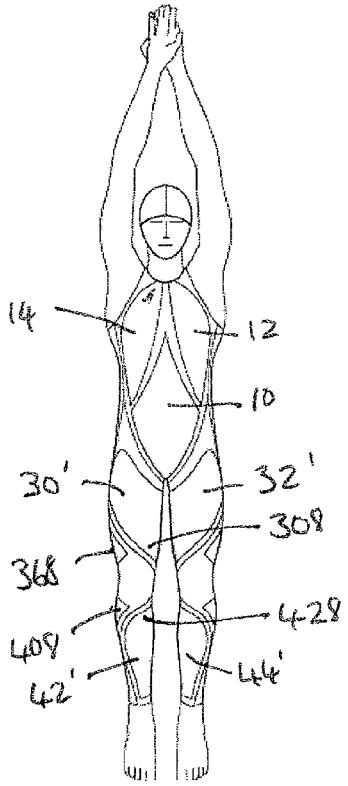
FIG. 4 is a front view of a full body suit with no arms, adapted especially for the breaststroke.
Figure 6:
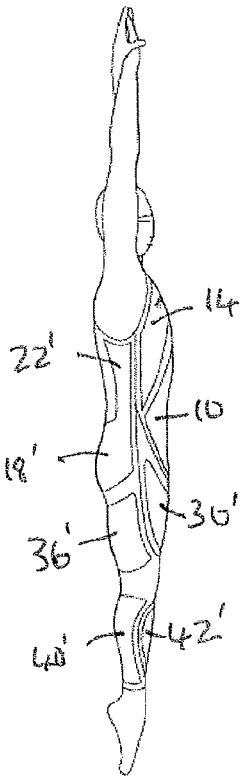
FIG. 6 is a side view of the FIG. 4 suit.
Figure 5:
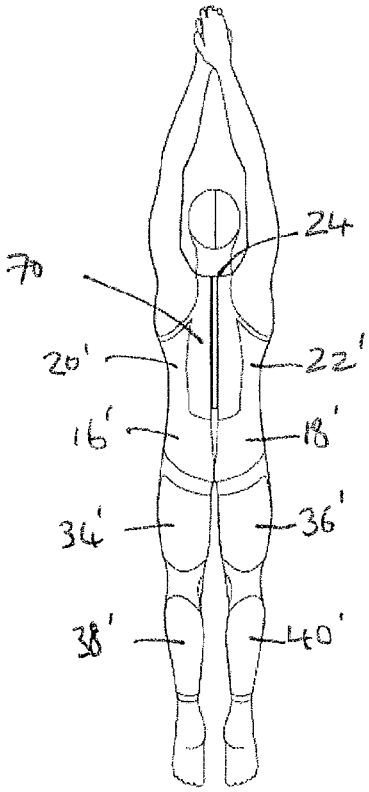
FIG. 5 is a back view of the FIG. 4 suit.

Turning to FIGS. 4 to 6, a suit specifically adapted for breaststroke is shown. The underlying base layer of the suit is identical to the freestyle suit described above. The disposition of the panels laminated on the outer surface of the base layer differs, however.

Some of the panels are common to both suits. For example, the breaststroke suit has the same abdominal and chest panels 10, 12, 14 as the freestyle suit, providing core stability, improved form (for a reduction in form drag) of the chest and a reduction in surface drag of the front of the torso in the same manner as described above. The suit also has the same overall layout of panels as the freestyle suit but the specific form of the panels is adapted to be more tailored to the motions of the breaststroke.

Looking at FIG. 5, for example, it can be seen that whilst the lumbar panels 16', 18' have the same form as those of the freestyle suit described above, the back panels 20', 22' formed integrally with the lumbar panels 16', 20' are very different in form to those of the freestyle suit. Specifically, the right-side back panel 22' extends from the upper edge of the lumbar panel 18' up the lateral side of the back to the arm opening 26, wrapping around the side of the torso to close to the mid-line of the torso side. The left-side back panel 20' is a mirror image of the right-side panel 22'.

There is a broad, panel free strip 70 extending down the centre of the back from the neck opening 24 of the suit to the top edge of the lumbar panels 16', 22'.

This specific configuration of the back panels helps to retain the swimmer's torso in-line in the water, resisting twisting of the torso, whilst allowing the arching of the swimmer's back needed for execution of the stroke.

The leg panels 30', 32', 34', 36', 38', 40', 42', 44' of the breaststroke suit also differ in shape to those of the freestyle suit of FIGS. 1 to 3. Looking at the right leg (the left leg is a mirror image), the calf panel 40' is shaped to wrap further forward around the lateral side of the leg below the knee and at the ankle than in the middle of the calf. The shin panel 42' is correspondingly foreshortened laterally to retain a spacing between the calf panel 40' and the shin panel 42'. The quad panel 30' does not extend as far up as that on the freestyle suit. It stops at the hip so as not to hinder the greater articulation of the hip joint required in the breaststroke leg movement. The lower lateral corner of the hamstring panel 36' also wraps around towards the front of the leg just above the knee.

As seen best in FIG. 4, the combination of the upper, medial portion 428 of the shin panel 42', the upper lateral portion 408 of the calf panel 40', the lower medial portion 308 of the quad panel 30' and the lower lateral portion 368 of the hamstring panel 36' cradle the front of the knee joint to better support its articulation during the breaststroke leg movement.

In another suit adapted for breaststroke (not illustrated) the legs are cut off just above the knee. This gives greater freedom for movement of the swimmer's legs when executing the breaststroke leg kick. Otherwise it is identical to the suit of FIGS. 4 to 6.

Figure 7:
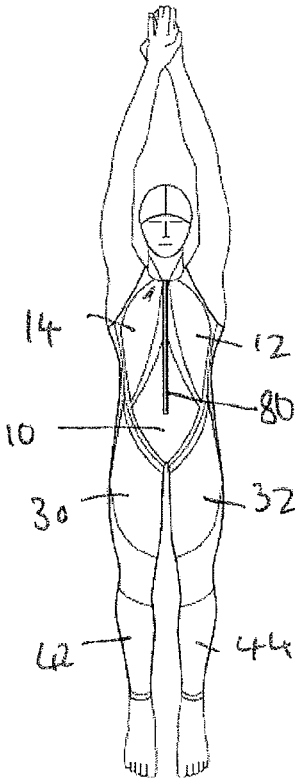
FIG. 7 is a front view of a full body suit with no arms, adapted especially for the backstroke.
Figure 9:
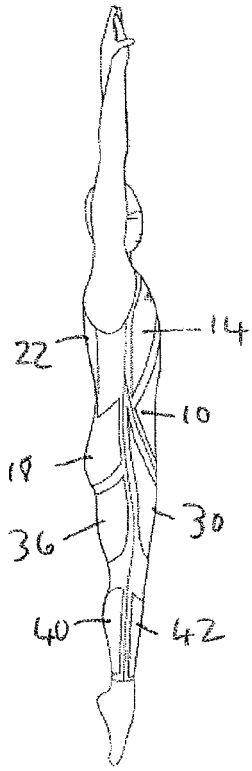
FIG. 9 is a side view of the FIG. 7 suit.
Figure 8:
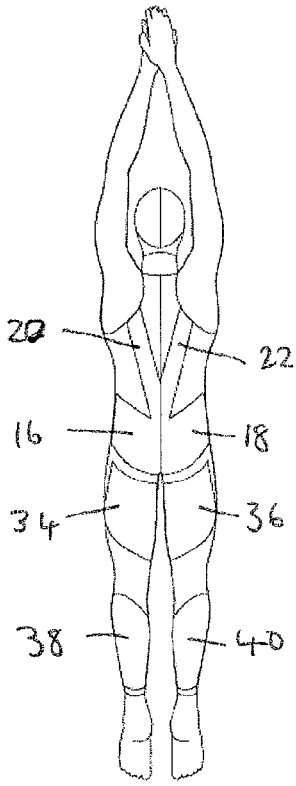
FIG. 8 is a back view of the FIG. 7 suit.

FIGS. 7 to 9 show another suit in accordance with an embodiment of the invention especially adapted for backstroke. The panels 10-22, 30-44 laminated on the base layer of the suit are the same as those used in the freestyle suit of FIGS. 1 to 3. In this backstroke suit, however, unlike the freestyle suit, the zip fastener 80 extends down the centre of the front of the suit.

Figure 10:
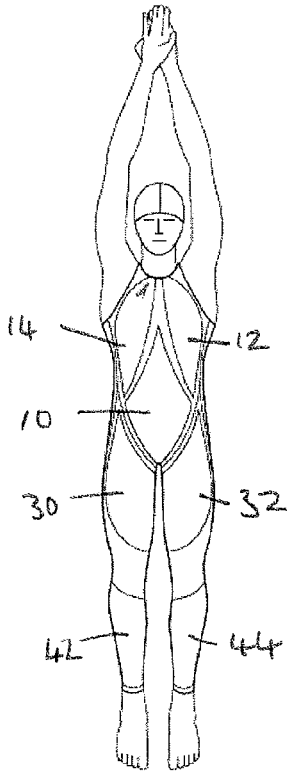
FIG. 10 is a front view of a full body suit with no arms, adapted especially for the butterfly stroke.
Figure 12:
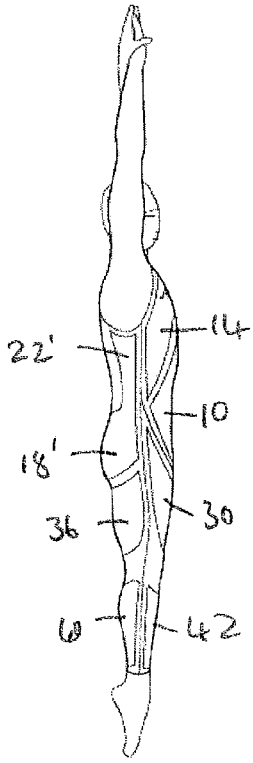
FIG. 12 is a side view of the FIG. 10 suit.
Figure 11:
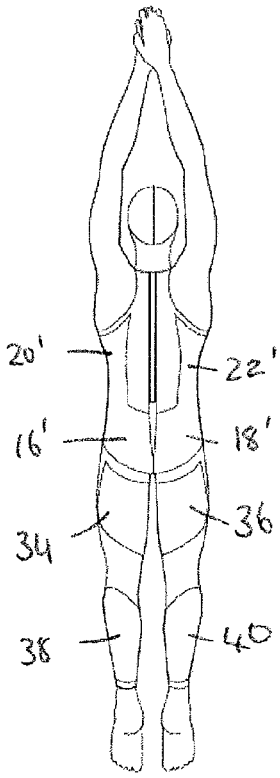
FIG. 11 is a back view of the FIG. 10 suit.

FIGS. 10 to 12 show another suit in accordance with an embodiment of the invention especially adapted for the butterfly stroke. The abdominal, chest and leg panels, 10, 13, 14, 30-44 are as in the freestyle and backstroke suits described above. The lumbar and back panels 16', 18', 20', 22' are as in the breaststroke suit of FIGS. 4 to 6.

FIGS. 15 to 34 show further examples of different styles of swimsuit having panels laminated to the outside surface of the base layer in accordance with embodiments of the invention. In these drawings the white areas indicate the base layer fabric, the light grey shaded areas are the laminated panels and the dark grey shading is used to illustrate arms made from a fabric that is different from the base layer fabric.

As seen in the figures, the suits of FIGS. 15 to 34 differ in style and/or in the number of panels that are laminated on the base layer.

Figure 15:
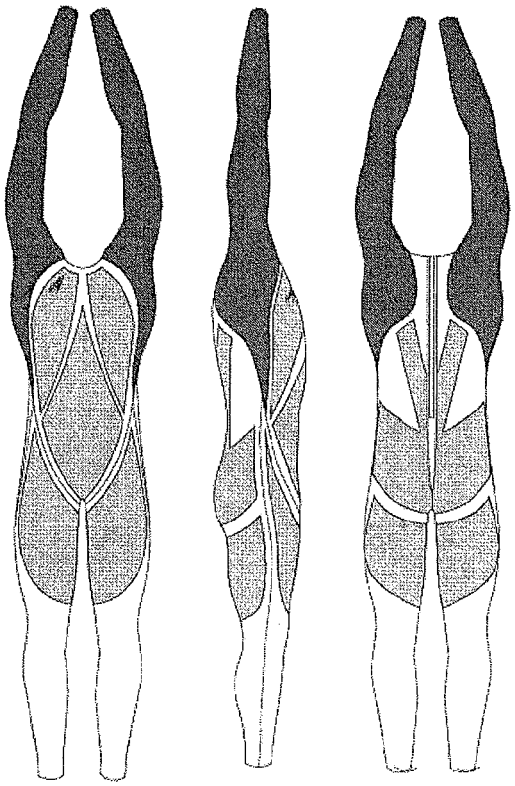
FIG. 15 shows front, side and back views of a full body suit, including arms, adapted especially for the freestyle stroke for a male swimmer.
Figure 16:
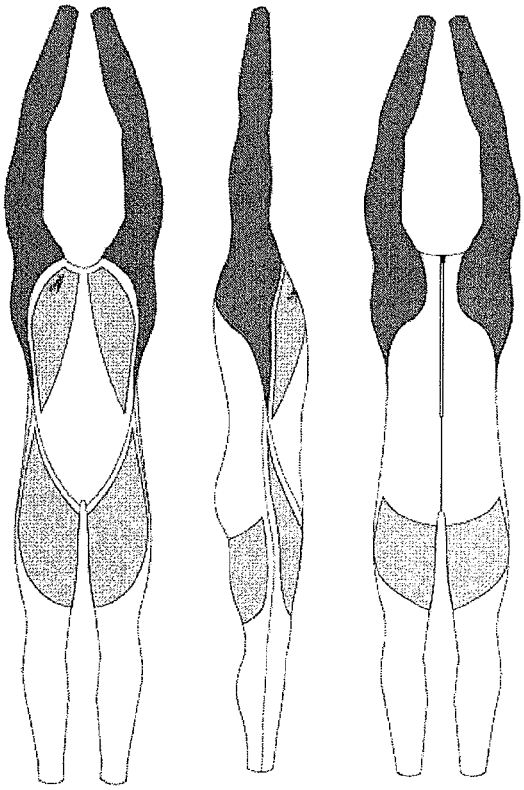
FIG. 16 shows front, side and back views of another full body suit, including arms, adapted especially for the freestyle stroke for a male swimmer.
Figure 17:
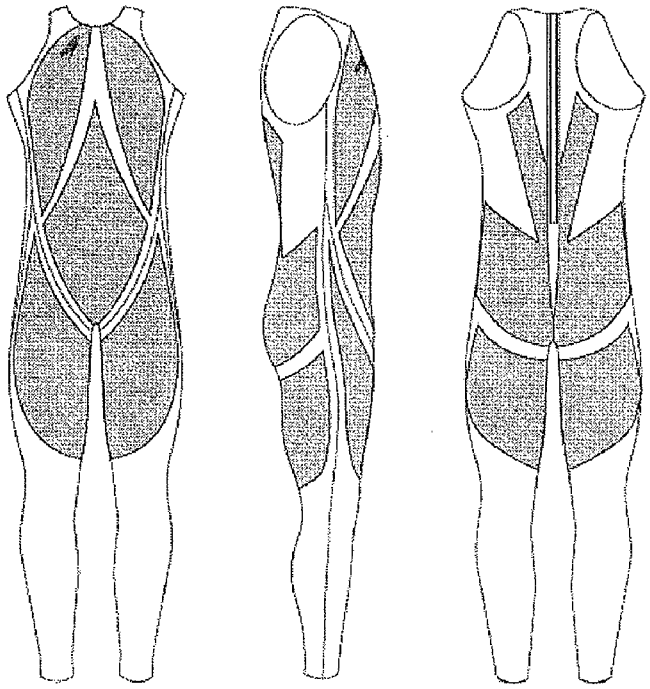
FIG. 17 shows front, side and back views of a full body suit, with no arms, adapted especially for the freestyle stroke for a male swimmer.
Figure 18:
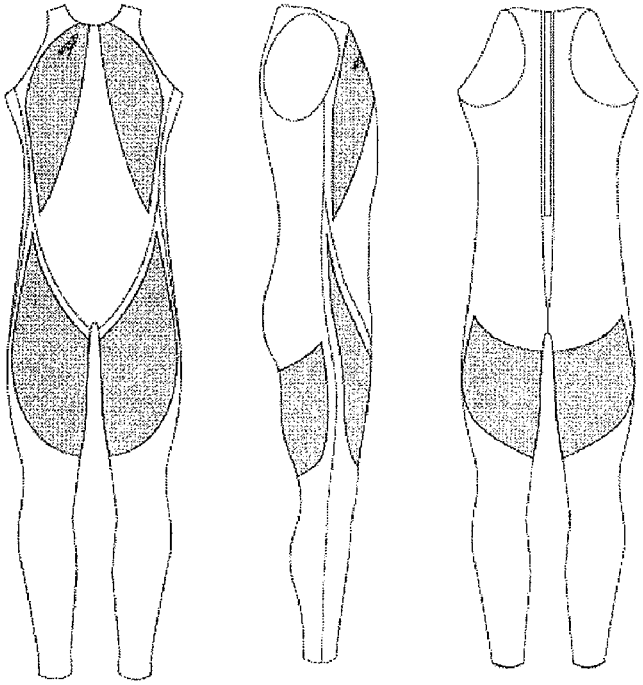
FIG. 18 shows front, side and back views of another full body suit, with no arms, adapted especially for the freestyle stroke for a male swimmer.

For example, comparing FIGS. 15 and 16, which show the same style of full body suit (with arms), it can be seen that whereas the suit of FIG. 15 has panels largely as described above (save for the absence of lower leg panels), the suit of FIG. 16 does not have back panels or lumbar panels and nor does it have an abdominal panel.

Similarly, it can be seen that the suits of FIGS. 18, 22, 24, 26, 28, 30, 32 and 34, also do not have back, lumbar and abdominal panels. The suits of FIGS. 22, 30 and 34 additionally lack hamstring panels.

Figure 19:
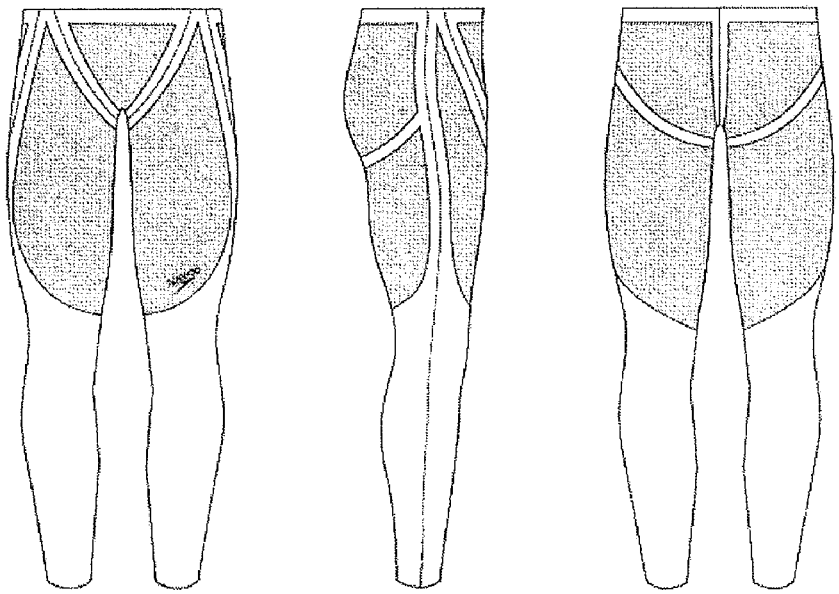
FIG. 19 shows front, side and back views of a legskin suit adapted especially for the freestyle stroke for a male swimmer.
Figure 20:
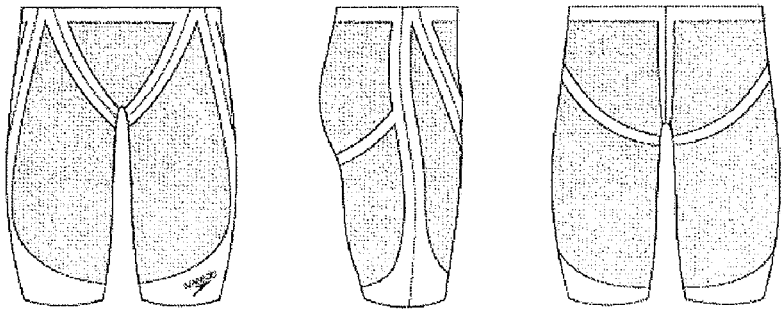
FIG. 20 shows front, side and back views of a 'jammer' style suit, adapted especially for the freestyle stroke for a male swimmer.
Figure 21:
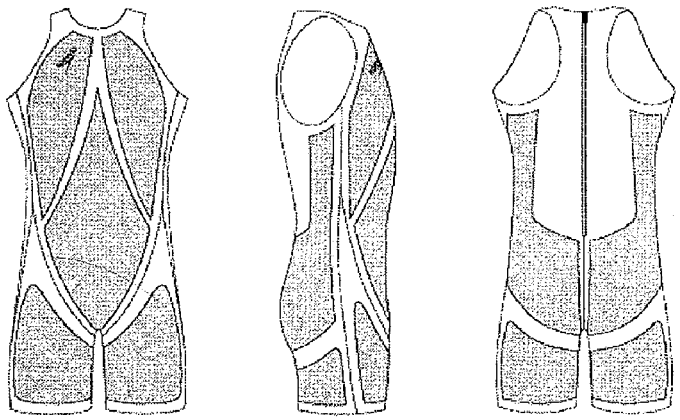
FIG. 21 shows front, side and back views of a kneeskin suit, adapted especially for the breaststroke for a male swimmer.
Figure 22:
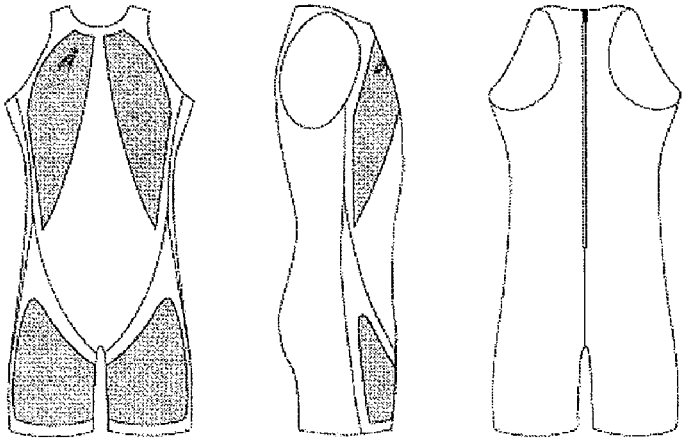
FIG. 22 shows front, side and back views of another kneeskin suit, adapted especially for the breaststroke stroke for a male swimmer.
Figure 23:
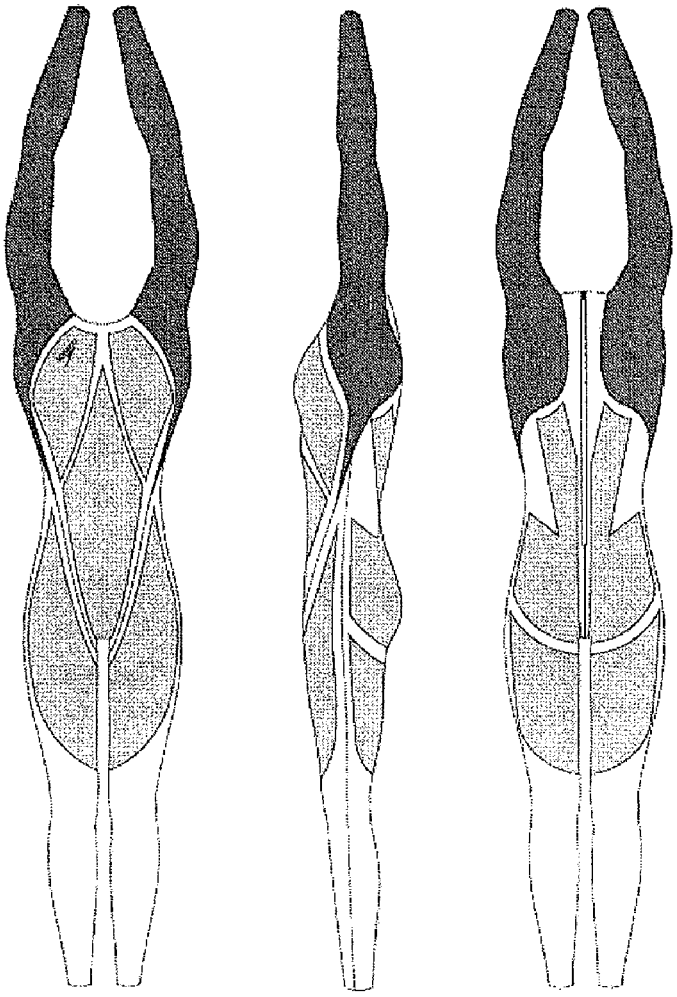
FIG. 23 shows front, side and back views of a full body suit, including arms, adapted especially for the freestyle stroke for a female swimmer.
Figure 24:
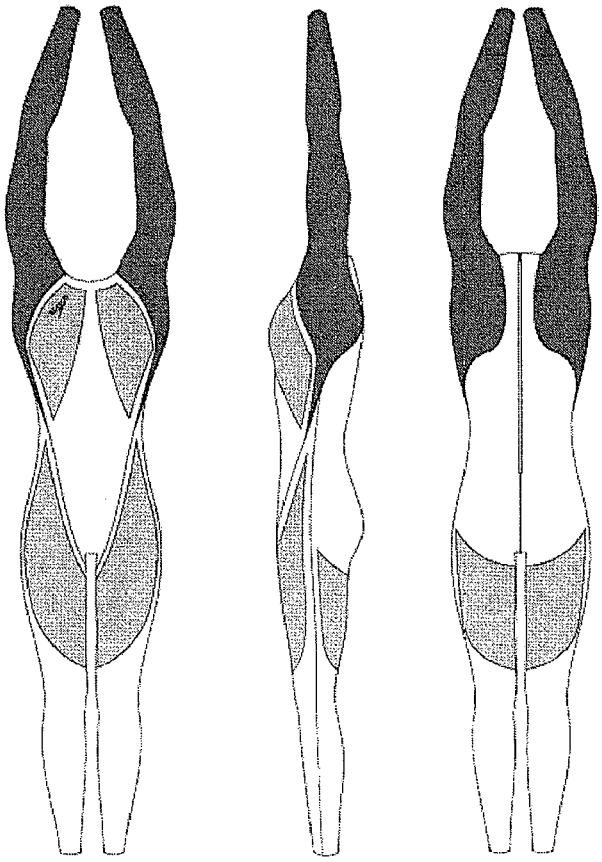
FIG. 24 shows front, side and back views of another full body suit, including arms, adapted especially for the freestyle stroke for a female swimmer.
Figure 25:
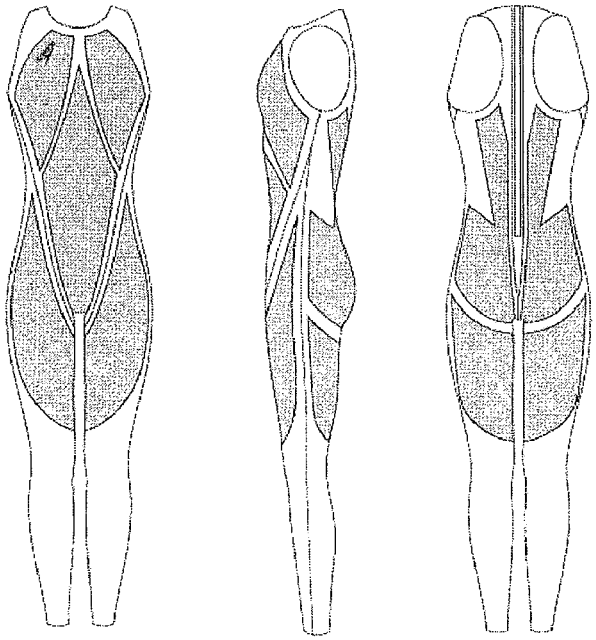
FIG. 25 shows front, side and back views of a full body suit, with no arms, adapted especially for the freestyle stroke for a female swimmer.
Figure 26:
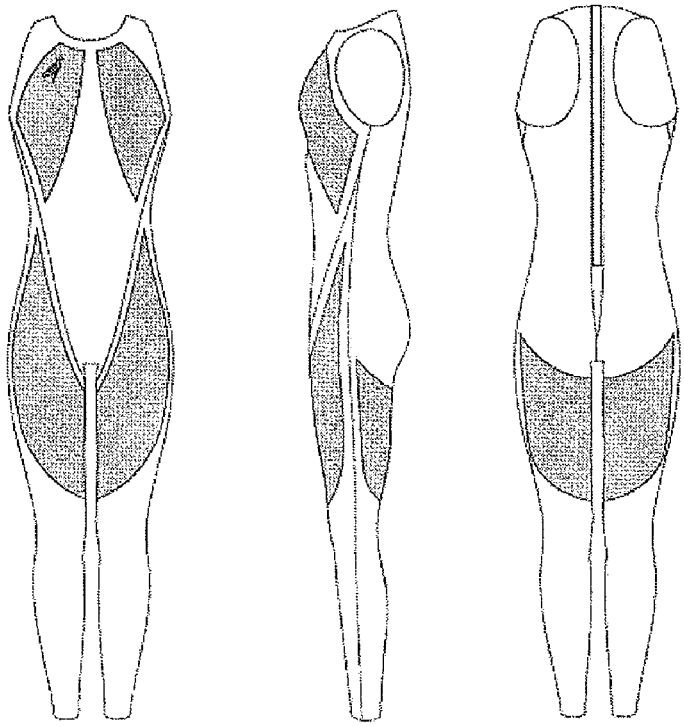
FIG. 26 shows front, side and back views of another full body suit, with no arms, adapted especially for the freestyle stroke for a female swimmer.
Figure 27:
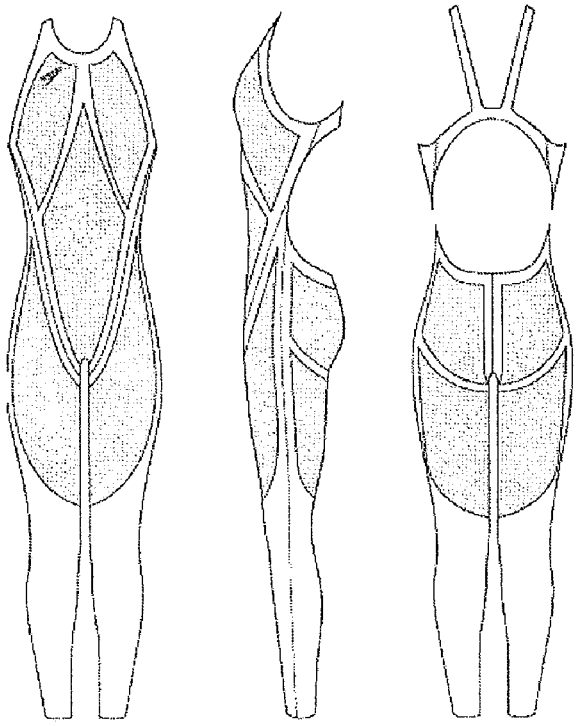
FIG. 27 shows front, side and back views of a 'recordbreaker body' style suit, adapted especially for the freestyle stroke for a female swimmer.
Figure 28:
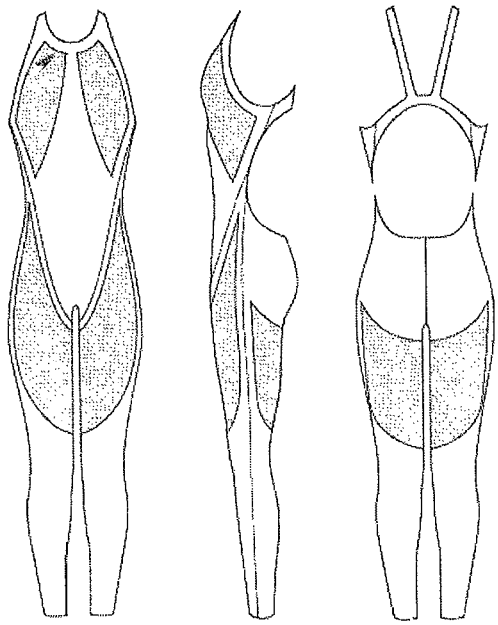
FIG. 28 shows front, side and back views of another 'recordbreaker body' style suit, adapted especially for the freestyle stroke for a female swimmer.
Figure 29:
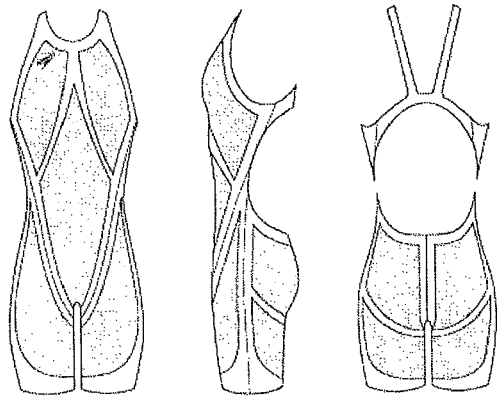
FIG. 29 shows front, side and back views of a 'recordbreaker' kneeskin suit, adapted especially for the freestyle stroke for a female swimmer.
Figure 30:
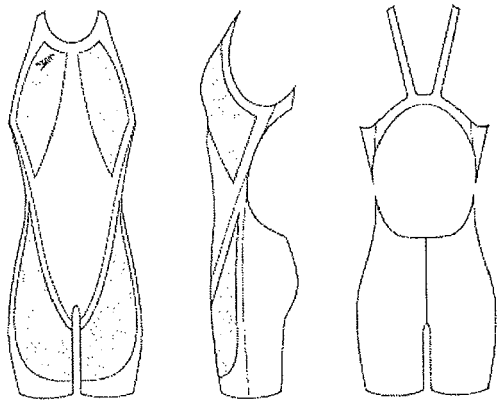
FIG. 30 shows front, side and back views of another 'recordbreaker' kneeskin suit, adapted especially for the freestyle stroke for a female swimmer.
Figure 31:
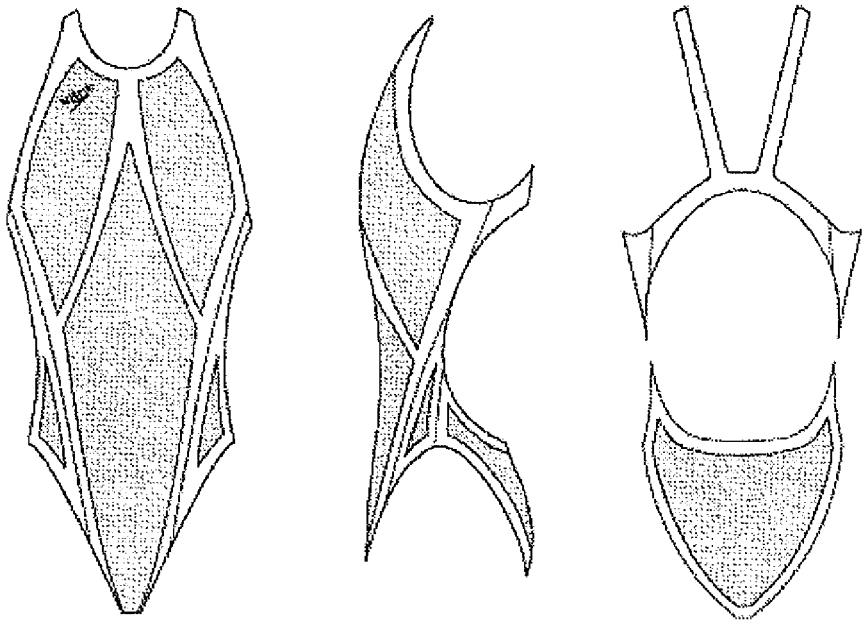
FIG. 31 shows front, side and back views of a 'recordbreaker' style suit, adapted especially for the freestyle stroke for a female swimmer.
Figure 32:
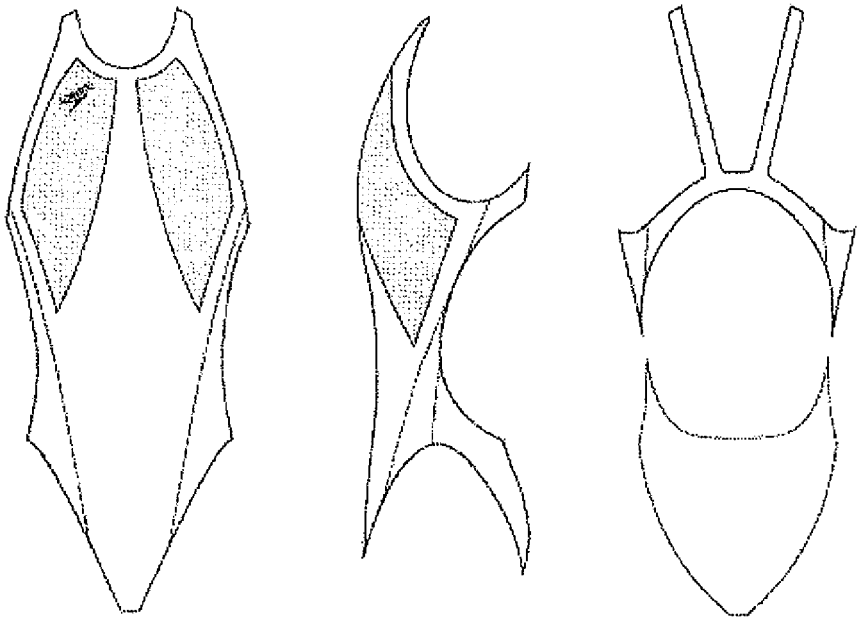
FIG. 32 shows front, side and back views of another 'recordbreaker' style suit, adapted especially for the freestyle stroke for a female swimmer.
Figure 33:
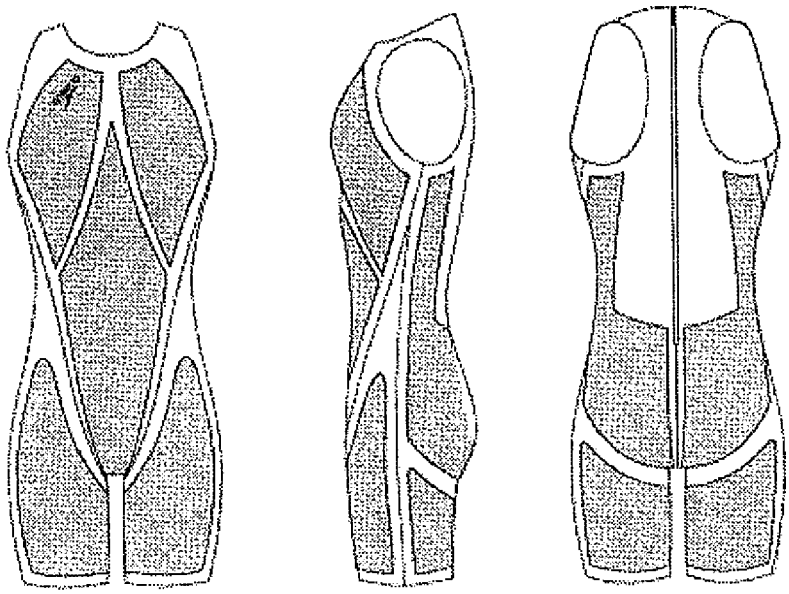
FIG. 33 shows front, side and back views of a kneeskin suit, adapted especially for the breaststroke for a female swimmer.
Figure 34:
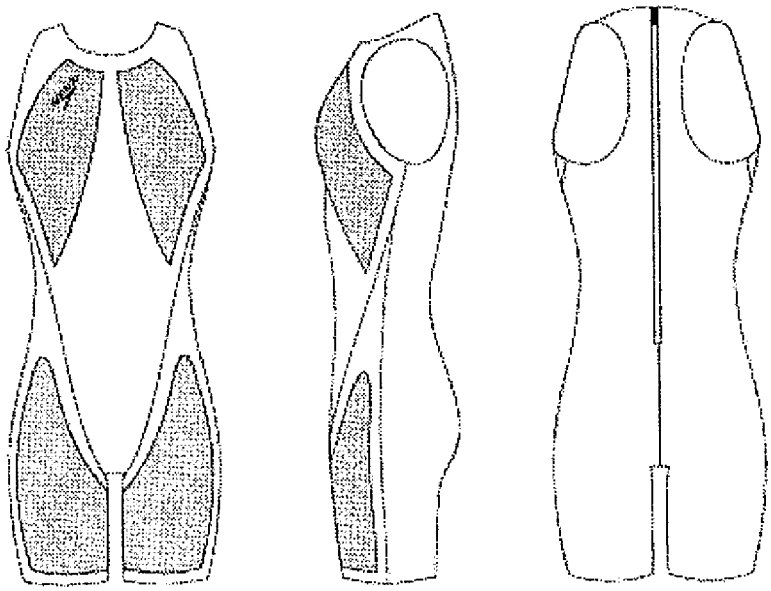
FIG. 34 shows front, side and back views of another kneeskin suit, adapted especially for the breaststroke stroke for a female swimmer.

FIGS. 19 and 20 show leg only suits for male swimmers. In FIG. 19, the suit extends the full length of the swimmers legs (a so called "legskin"). Upper leg panels are shown, along with truncated (at the upper edge) addominal and lumbar panels. In this example there are no lower leg panels but other embodiments might include lower leg panels, for example of the form seen in FIGS. 1 to 3. The FIG. 20 suit is a so called "jammer", extending down only as far as the knees.

The skilled person will appreciate that the suits illustrated in the figures and described above are examples embodying inventive concepts described herein and that many and various modifications to the specifically described suits, including the number, disposition and shape of the laminated panels can be made without departing from the invention. The principles exemplified above can also be applied to other specialist sports garments, especially wet sports such as waterpolo and triathlon and beach sports such as beach volley.

The invention claimed is:

1. A garment having:

a base layer of stretchable elastic fabric having a torso portion that covers at least part of the torso of a wearer;

a plurality of panels laminated on the outer surface of the base layer, the panels formed of a material having an outer surface that exhibits lower surface drag in water than the underlying base layer, each of the panels separated from the other panels by an exposed portion of the base layer, said panels including an abdominal panel covering the abdomen of the wearer and extending upwardly centrally to the wearer's sternum region, and a pair of chest panels which are generally triangular and which are located laterally one on each side of the abdominal panel and which extend downwardly to a level lower than the uppermost end of the abdominal panel, and wherein the panels cover at least 50% of a front side of the torso portion of the garment.

2. A garment according to claim 1, wherein the panels cover 50% or more of the torso portion of the garment.

3. A garment according to claim 1, wherein the panels cover 20% or more of a rear side of the torso portion of the garment.

4. A garment according to claim 1, wherein the panels cover 50% or more of a rear side of the torso portion of the garment.

5. A garment according to claim 1, wherein the panels cover more of a front side of the torso portion of the garment than of a rear side of the torso portion of the garment.

6. A garment according to claim 1, wherein the garment has a pair of leg portions that cover at least a part of a person's legs when worn, each leg portion having one or more panels laminated on their outer surface.

7. A garment according to claim 1, the garment comprising a pair of arm portions for covering at least part of a person's arms when worn, the arm portions being free of any laminated panels.

8. A garment according to claim 1, wherein the panels applied to the base layer are formed of a material having a higher stretch constant than that of the underlying base layer.

9. A garment according to claim 1, wherein the panels comprise polyurethane sheet material.

10. A garment according to claim 1, wherein one or more of the panels have different material properties than one another.

11. A garment according to claim 1, wherein the garment comprises a zip fastener, the zip fastener being fastened to the garment with what would normally be the underside of the zip facing outwards, so that the flat underside of the zip teeth is facing externally.

12. A garment having:

a base layer of stretchable elastic fabric having a torso portion that covers at least part of the torso of a wearer;

a plurality of panels laminated on the outer surface of the base layer, the panels formed of a material having an outer surface that exhibits lower surface drag in water than the underlying base layer, each of the panels separated from the other panels by an exposed portion of the base layer, said panels including a combined lumbar and buttocks panel covering the lumbar region and the buttocks of a wearer, and rear quadriceps panels extending over the hamstring muscle groups of each of the wearer's legs at the rear of each of the wearer's thighs, the lumbar and buttocks panel being separated vertically from the quadriceps panels by an exposed portion of the base layer, and wherein the upper ends of the quadriceps panels do not cover the wearer's buttocks, and wherein the panels cover at least 50% of a front side of the torso portion of the garment.

13. A garment according to claim 12, wherein the panels cover 50% or more of the torso portion of the garment.

14. A garment according to claim 12, wherein the panels cover 20% or more of a rear side of the torso portion of the garment.

15. A garment according to claim 12, wherein the panels cover 50% or more of a rear side of the torso portion of the garment.

16. A garment according to claim 12, wherein the panels cover more of a front side of the torso portion of the garment than of a rear side of the torso portion of the garment.

17. A garment according to claim 12, wherein the garment has a pair of leg portions that cover at least a part of a person's legs when worn, each leg portion having one or more panels laminated on their outer surface.

18. A garment according to claim 12, the garment comprising a pair of arm portions for covering at least part of a person's arms when worn, the arm portions being free of any laminated panels.

19. A garment according to claim 12, wherein the panels applied to the base layer are formed of a material having a higher stretch constant than that of the underlying base layer.

20. A garment according to claim 12, wherein the panels comprise polyurethane sheet material.

21. A garment according to claim 12, wherein one or more of the panels have different material properties than one another.

22. A garment having:

a base layer of stretchable elastic fabric having a torso portion that covers at least part of the torso of a wearer;

a plurality of panels laminated on the outer surface of the base layer, the panels formed of a material having an outer surface that exhibits lower surface drag in water than the underlying base layer, each of the panels separated from the other panels by an exposed portion of the base layer, said panels including an abdominal panel covering the abdomen of the wearer and extending upwardly centrally to the wearer's sternum region, and a pair of chest panels which are generally triangular and which are located laterally one on each side of the abdominal panel and which extend downwardly to a level lower than the uppermost end of the abdominal panel, and wherein the garment comprises a zip fastener, the zip fastener being fastened to the garment with what would normally be the underside of the zip facing outwards, so that the flat underside of the zip teeth is facing externally.

23. A garment having:

a base layer of stretchable elastic fabric having a torso portion that covers at least part of the torso of a wearer;

a plurality of panels laminated on the outer surface of the base layer, the panels formed of a material having an outer surface that exhibits lower surface drag in water than the underlying base layer, each of the panels separated from the other panels by an exposed portion of the base layer, said panels including an abdominal panel covering the abdomen of the wearer and extending upwardly centrally to the wearer's sternum region, and a pair of chest panels which are generally triangular and which are located laterally one on each side of the abdominal panel and which extend downwardly to a level lower than the uppermost end of the abdominal panel, and wherein the garment comprising a pair of arm portions for covering at least part of a person's arms when worn, the arm portions being free of any laminated panels.

* * * * *